US005590873A

United States Patent [19]

Smart et al.

[11] Patent Number: 5,590,873

[45] Date of Patent: Jan. 7, 1997

[54] DOCUMENT SET ACCUMULATOR HAVING SHAFT-MOUNTED MULTI-GROOVED PULLEYS FOR TOOL-LESS ADJUSTMENT OF LATERAL BELT POSITIONING

[75] Inventors: Michael Smart, Easton, Pa.; Steven McCay, Raleigh, N.C.

[73] Assignee: Bell & Howell Phillipsburg Company, Allentown, Pa.

[21] Appl. No.: 544,821

[22] Filed: Oct. 18, 1995

[51] Int. Cl.[6] ..... B65H 39/10

[52] U.S. Cl. ..... 271/303; 271/198; 271/213; 271/223; 271/272; 198/584; 198/817

[58] Field of Search ..... 271/303, 304, 271/198, 213, 223, 272; 198/584, 817

[56] References Cited

U.S. PATENT DOCUMENTS

| | | | |
|---|---|---|---|
| 2,712,925 | 7/1955 | Wolfe | 194/584 |
| 3,908,985 | 9/1975 | Wisemen | 271/199 |
| 4,799,663 | 1/1989 | Golicz | 271/199 |
| 4,900,067 | 2/1990 | Gammerler | 271/272 |
| 5,083,769 | 1/1992 | Young | 271/303 |
| 5,147,092 | 9/1992 | Driscoll et al. | 271/223 |
| 5,209,339 | 5/1993 | Antonissen | 198/817 |
| 5,244,200 | 9/1993 | Manzke | 271/213 |
| 5,342,038 | 8/1994 | Suter | 271/223 |

*Primary Examiner*—H. Grant Skaggs

*Attorney, Agent, or Firm*—Millen, White, Zelano & Branigan P.C.

[57] ABSTRACT

A document accumulator capable of tool-less adjustment to accommodate a plurality of paper sizes includes first and second shafts laterally oriented across a paper path through the accumulator, first and second multi-grooved pulleys affixed to the first and second shafts, respectively, and at least one endless belt extending between the shafts, the endless belt engaging a first groove of the first multi-grooved pulley and a first groove of the second multi-grooved pulley. The belt is translatable without the use of tools into a second groove of the first multi-grooved pulley and a second groove of the second multi-grooved pulley for making a paper-size adjustment.

8 Claims, 1 Drawing Sheet

DOCUMENT SET ACCUMULATOR HAVING SHAFT-MOUNTED MULTI-GROOVED PULLEYS FOR TOOL-LESS ADJUSTMENT OF LATERAL BELT POSITIONING

BACKGROUND OF THE INVENTION

1. Field of the Invention

The invention relates in general to insertion machines for compiling sets of documents and inserting such sets into envelopes, and in particular to an accumulator device having belt pulleys for tool-less adjustment of lateral belt positioning.

2. Related Art

Ramp accumulators are well-known for accumulating sets of documents from a stream of documents fed seriatim thereto. Such accumulators typically include at least two driven belts which engage a document at its upper and lower surface, respectively, shaft-mounted pulleys for directing and driving the belts, two side guides which engage and guide the edges of documents being transported by the belts, a ramp for directing the document upward onto the top of a stack of accumulated documents ("over-accumulation") or downward under a stack of documents ("under-accumulation"), and a sheet-restraining means for preventing the stacked documents from being fed by the belts until all sheets for a particular set have been accumulated.

Accumulators of the prior art are typically designed to handle a single paper size. That is, variables such as the lateral positioning of the belts, the lateral and longitudinal positioning of the ramps, and the distance between the side guides have been either permanently set or have been adjustable only through time-consuming procedures involving, e.g., the loosening and tightening of various set screws.

OBJECTS AND SUMMARY OF THE INVENTION

It is therefore an object of the invention to provide an accumulator which is quickly configurable for various paper sizes without the use of tools.

The invention according to a preferred embodiment comprises an accumulator capable of tool-less adjustment to accomodate a plurality of paper sizes, the accumulator including first and second shafts laterally oriented across a paper path through the accumulator, first and second multi-grooved pulleys affixed to the first and second shafts, respectively, and at least one endless belt extending between the shafts, the endless belt engaging a first groove of the first multi-grooved pulley and a first groove of the second multi-grooved pulley. The belt is translatable without the use of tools into a second groove of the first multi-grooved pulley and a second groove of the second multi-grooved pulley for making a paper-size adjustment.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION

Figure 1:
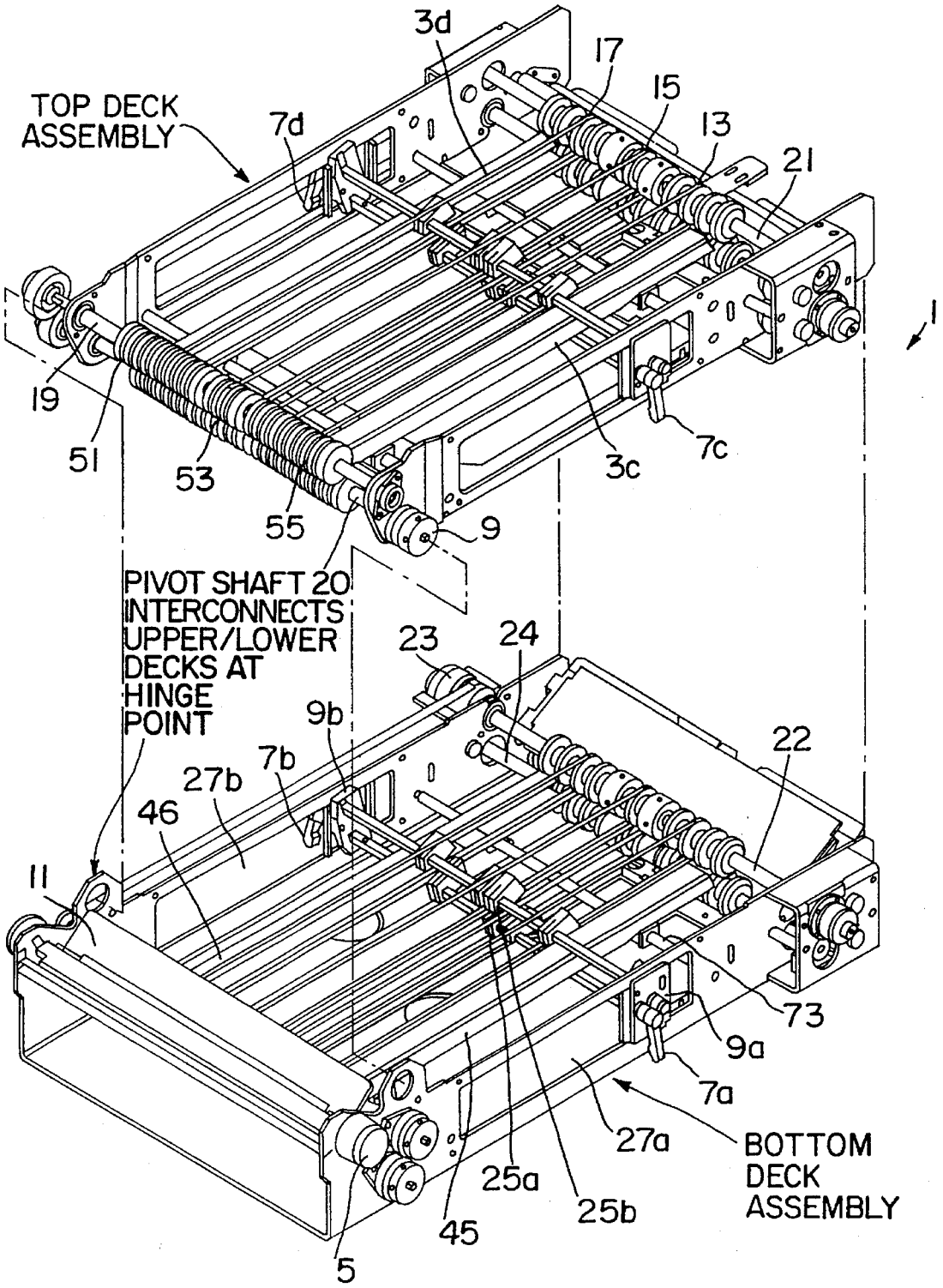
FIG. 1 is a perspective view illustrating the accumulator of the invention.

FIG. 1 illustrates a double-level accumulator 1 having top and bottom deck assemblies and a divert gate 11 for selecting whether documents fed to the accumulator will be received in the lower or upper deck. Deck selection is controlled via operation of the gate solenoid 5 to position the divert gate 11. During steady state operation, the deck selection will normally alternate at each new set.

Each deck comprises an upper and lower belt assembly, with each assembly comprising three belts, e.g., belts 13, 15, and 17, which are retained by three pulleys mounted on each of the respective shafts, e.g., shafts 19 and 21. The belts are preferably the "round" type, also known in the art as "spaghetti belts." Motion of the belts is accomplished via a clutch 23 operably connected to a motor.

Each deck comprises at least two ramps, e.g., **25*a* and 25*b*, for performing over-accumulation and under-accumulation, respectively. Each ramp is mounted on a shalt which is in-turn connected at a first end to a first rotating assembly 9*a* and at a second end to a second rotating assembly 9*b*. Release levers 7*a*, 7*b*, 7*c*, and 7*d* can be operated without the use of tools to permit the rotating assemblies 9*a* and 9*b*** to be rotated upwards for over-accumulation or downwards for under-accumulation.

When the assemblies **9*a* and 9*b* are rotated upward, the lower ramp 25*a* engages an incoming sheet and directs it upward onto the top of a stack of accumulated documents. When the assemblies 9*a* and 9*b* are rotated downward, the upper ramp 25*b* engages an incoming sheet and directs it downward under a stack of accumulated documents. The rotating assemblies 9*a* and 9*b* are also longitudinally translatable in slots 27*a* and 27*b* to adjust for various paper lengths. Side guides 45, 46, 3*c*, and 3*d*** are provided for guiding the outer edges of documents as they are transported through the accumulator. All of the side guides are laterally translatable to adjust for various paper widths.

Three multi-grooved pulleys 51, 53, and 55 are mounted on the shaft 19. A similar configuration is used on the other shafts, e.g., 20, 22, 24, etc. Each of the three endless belts 13, 15, and 17 engage one groove of each of the multi-grooved pulleys 51, 53, and 55, respectively, such that each belt extends between the shafts 19 and 21. By providing multiple grooves into which a belt can be placed, the accumulator can be easily reconfigured for various paper sizes.

For example, for accumulating sheets having a relatively wide paper width, the belts 13 and 17 can by physically moved by an operator, without the use of tools, into the outer grooves of the multi-grooved pulleys 55 and 51, respectively. Likewise, for accumulating sheets having a relatively narrow paper width, the belts 13 and 17 can be physically moved into the inner grooves of the multi-grooved pulleys 55 and 51. Similar adjustments can then be made between grooves of the other pulleys in the system. In this manner, the accumulator can be quickly and easily configured for paper widths ranging from, e.g., 6 inches wide to 12 inches wide. It should be understood that a "multi-grooved pulley" within the scope of the invention could include, e.g., two or more adjacent pulleys having single grooves.

The pivot shaft shown in FIG. 1, which is a drive shaft for the upper deck, serves also to interconnect the upper and lower decks such that it becomes a hinge point around which the upper deck can be rotated. This facilitates access to the lower deck by releasing and pivoting up the upper deck without the need for a time-consuming deck-removal process.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. A document accumulator capable of tool-less adjustment to accomodate a plurality of paper sizes, comprising:

first and second shaft means laterally oriented across a paper path through said accumulator;

first and second multi-grooved pulley means affixed to said first and second shaft means, respectively;

at least one endless belt extending between said first and second shaft means, said endless belt engaging a first groove of said first multi-grooved pulley means and a first groove of said second multi-grooved pulley means, said belt being translatable without the use of tools into a second groove of said first multi-grooved pulley means and a second groove of said second multi-grooved pulley means for making a paper-size adjustment; and, means for accumulating a series of documents into a stack of documents.

2. The document accumulator according to claim 1, further comprising:

third and fourth multi-grooved pulley means affixed to said first and second shaft means, respectively;

a second endless belt extending between said first and second shaft means, said second endless belt engaging a first groove of said third multi-grooved pulley means and a first groove of said fourth multi-grooved pulley means, said second endless belt being translatable without the use of tools into a second groove of said third multi-grooved pulley means and a second groove of said fourth multi-grooved pulley means for making a paper-size adjustment.

3. The document accumulator according to claim 1, wherein said first and second multi-grooved pulley means each comprise a single pulley having multiple grooves therein.

4. The document accumulator according to claim 1, wherein said first and second multi-grooved pulley means each comprise a plurality of adjacent pulleys, each of said adjacent pulleys having a single groove therein.

5. A multiple-level accumulator for accumulating a stack of documents from a series of documents, comprising:

a first deck assembly for receiving and stacking documents, said first deck assembly comprising a first transport means for transporting documents;

a second deck assembly for receiving and stacking documents, said second deck assembly being vertically adjacent to said first deck assembly and comprising a second transport means for transporting documents;

means for directing a document into either said first deck assembly or said second deck assembly;

first drive shaft means operably connected to said first transport means for driving said first transport means;

second drive shaft means operably connected to said second transport means for driving said second transport means;

said second deck assembly further comprising means for receiving said second drive shaft means and for creating a hinge point which permits said second deck assembly to be pivoted away from said first deck assembly to allow access to a space between said first and second deck assemblies.

6. The multiple-level accumulator according to claim 5, wherein said first deck assembly comprises a lower deck assembly and wherein said second deck assembly comprises an upper deck assembly.

7. The multiple-level accumulator according to claim 5, wherein each of said first and second transport means comprises a plurality of endless belts.

8. The multiple-level accumulator according to claim 5, wherein said means for directing comprises a divert gate.

* * * * *